United States Patent [19]

Sundquist et al.

[11] Patent Number: 5,044,619

[45] Date of Patent: Sep. 3, 1991

[54] CONTROL OF PRE-ORDERED STOCK

[75] Inventors: Douglas F. Sundquist; Joseph L. Filion, both of Rochester; Paul F. Schmitt, Palmyra; Eugene S. Evanitsky; Charles E. Smith, both of Pittsford, all of N.Y.

[73] Assignee: Xerox Corporation, Stamford, Conn.

[21] Appl. No.: 523,497

[22] Filed: May 14, 1990

[51] Int. Cl.[5] ..... B65H 39/02

[52] U.S. Cl. ..... 270/58; 270/95; 414/789.5

[58] Field of Search ..... 270/52, 58, 95, 55, 270/57; 355/322, 325; 414/789.5, 788.4, 789.6

[56] References Cited

U.S. PATENT DOCUMENTS 4,624,452 11/1986 Pulskamp ..... 270/95

FOREIGN PATENT DOCUMENTS 60866 3/1988 Japan ..... 270/95

*Primary Examiner*—Edward K. Look

*Assistant Examiner*—Therese M. Newholm

*Attorney, Agent, or Firm*—Ronald F. Chapuran

[57] ABSTRACT

A method of automatically placing ordered paper stock (covers or inserts) from sets of paper stock, the sets of paper stock comprised of an arbitrary number of covers or inserts, into finished copy sets. In a reproduction job run, and with the method of automatic recovery from a machine paper jam in which the copy sheets or paper stock in process has become misoriented comprising the steps of selecting an automatic paper stock ordering option at the operator interface, programming the required order of the paper stock in a finished set of reproduced documents, determining the repetitive frequency of the insert sheets, and automatically selectively inserting or discarding insert sheets in order to provide sets of copy sheets with uniformly placed paper stock. Also, a method for automatically recovering after an operator jam clearance by selectively purging paper stock to maintain the continuity of the ordered paper stock in the completed copy sets.

5 Claims, 8 Drawing Sheets

CONTROL OF PRE-ORDERED STOCK

BACKGROUND OF THE INVENTION

The invention relates to a system for controlling pre-ordered paper stock in reproduction machines such as copiers and printers, and more particularly, to methods and apparatus for purging unwanted paper stock such as covers or inserts to maintain uniform completed reproduction sets.

As reproduction machines such as copiers and printers become more complex and versatile in the jobs they can do, the user interface between the machine and the operator or user, which in essence permits the dialogue between operator and machine, must necessarily be expanded if full and efficient utilization of the machine is to be realized. This is particularly important when a complex reproduction job requires a document set output in a book form that includes paper stock such as covers and inserts, and the machine must maintain the order of the stock regardless of the manner in which the stock is provided and regardless of paper jams that involve the stock.

Various prior art techniques are directed to the control of covers and inserts in reproduction machines, for example:

U.S. Pat. No. 4,626,156 to Baughman et al. discloses a finishing apparatus with cover inserter which has a separate tray for covers located near a finisher station. See col. 3, lines 20–23. A means is provided to allow a user to specify how many covers and where they go. See Col. 4, 18–22.

U.S. Pat. No. 4,439,865 to Kikuchi et al. discloses a copier sorter with memory for manually inserted covers or partition sheets wherein a manual insert point is provided for covers and inserts. See col. 5, lines 9–16. The copier is provided with a number of sorters. A jam recovery algorithm is provided which counts all completed copies and takes care of manually inserted covers. See col. 16, lines 40–51 and col. 17, lines 15–26.

U.S. Pat. No. 4,211,483 to Hannigan et al. discloses a copy production machine having job separation and collation capabilities which automatically inserts separation pages Kikuchi jobs. See col. 4, lines 30–40. Two paper supplies are provided which allow separation sheets to be automatically fed. See col. 10, lines 55–60.

One difficulty with the prior art systems is that even though there is automatic control of the placement of covers and inserts, an operator must determine the precise number of covers and inserts to be loaded into the cover and insert trays. The prior art controls are not capable of automatically responding to a supply of covers or inserts that is out of sequence with the required number and placement of covers and inserts in the completed sets.

Another difficulty with the prior art systems is the deficiency of the systems in recovering from a machine paper jam. In the prior art, manual intervention of the operator is required not only to clear the jam, but to manually re-order the covers and inserts to restore the operation to correctly completed sets with proper positioning of all covers and inserts.

It would be desirable to be able to automatically recover all the paper stock after the operator initially clears a paper jam without further operator intervention to re-order the placement and sequence of the covers and inserts. It would also be desirable for an operator to be able to pre-load a plurality of sets of pre-ordered stock of x number of inserts per set, and be able to pre-program the control to provide a given number greater or less than x of inserts for each finished reproduced set of documents without any further operator intervention to position or order the inserts within the finished sets.

It is an object of the present invention, therefore, to provide a new and improved technique that allows the operator to load arbitrarily sized sets of pre-ordered stock such as covers and inserts into a machine and causes the machine to maintain the order of the pre-ordered stock to provide uniform finished copy sets. It is a further object of the present invention to provide a machine control that automatically purges unwanted copy sheets and pre-ordered stock during a reproduction run after a jam clearance to maintain the order of the pre-ordered stock to provide uniform finished copy sets. Further advantages of the present invention will become apparent as the following description proceeds and the features characterizing the invention will be pointed out with particularity in the claims annexed to and forming a part of this specification.

SUMMARY OF THE INVENTION

Briefly, the present invention is concerned with the method of automatically placing ordered paper stock (covers or inserts) from sets of paper stock, the sets of paper stock comprised of an arbitrary number of covers or inserts, into finished copy sets in a reproduction job run, and with the method of automatic recovery from a machine paper jam in which the copy sheets or paper stock in process have become misoriented comprising the steps of selecting an automatic paper stock ordering option at the operator interface, programming the required order of the paper stock in a finished set of reproduced documents, determining the repetitive frequency of the insert sheets, and automatically selectively inserting or discarding insert sheets in order to provide sets of copy sheets with correctly sequenced copies. Another feature of the invention is to automatically recover after an operator jam clearance by selectively purging paper stock to maintain the sequence of the ordered paper stock in the completed copy sets.

For a better understanding of the present invention, reference may be had to the accompanying drawings wherein the same reference numerals have been applied to like parts and wherein:

IN THE DRAWINGS

DETAILED DESCRIPTION OF THE INVENTION

Figure 1:
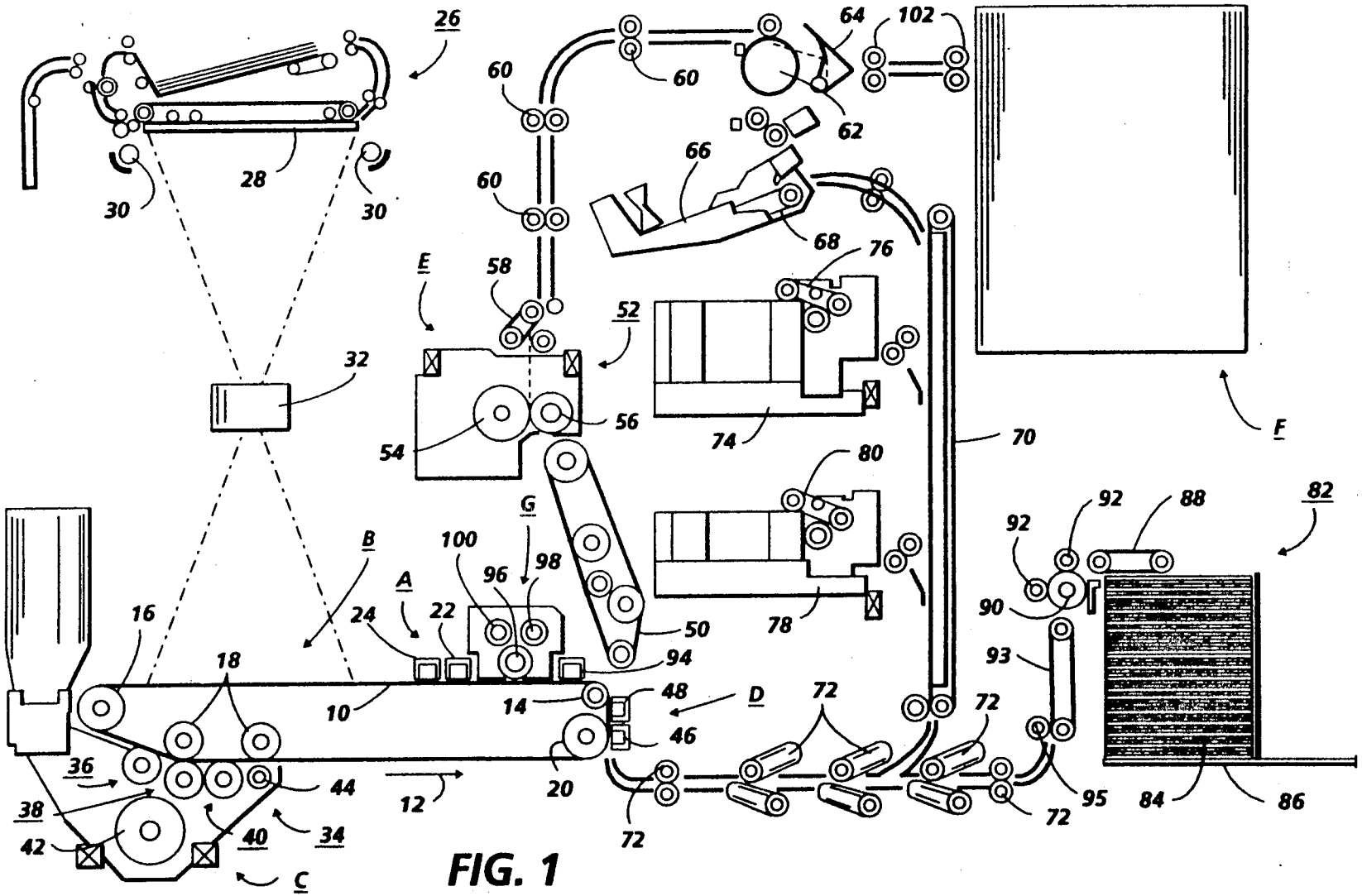
FIG. 1 is a schematic elevational view depicting various operating components and subsystems of a typical reproduction machine.

Referring to FIG. 1, there is shown an electrophotographic reproduction machine composed of a plurality of programmable components and subsystems which cooperate to carry out the copying or printing job programmed through a touch dialogue User Interface (U.I.). The machine employs a photoconductive belt 10. Belt 10 is entrained about stripping roller 14, tensioning roller 16, idler rollers 18, and drive roller 20. Driver roller 20 is rotated by a motor coupled thereto by suitable means such as a belt drive. As roller 20 rotates, it advances belt 10 in the direction of arrow 12 through the various processing stations disposed about the path of movement thereof.

Initially, the photoconductive surface of belt 10 passes through charging station A where two corona generating devices, indicated generally by the reference numerals 22 and 24 charge photoconductive belt 10 to a relatively high, substantially uniform potential. Next, the charged photoconductive belt is advanced through imaging station B. At imaging station B, a document handling unit 26 sequentially feeds documents from a stack of documents in a document stacking and holding tray into registered position on platen 28. A pair of Xenon flash lamps 30 mounted in the optics cavity illuminate the document on platen 28, the light rays reflected from the document being focused by lens 32 onto belt 10 to expose and record an electrostatic latent image on photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36, 38. Developer roll 40 is a cleanup roll while a magnetic roll 44 is provided to remove any carrier granules adhering to belt 10.

Following development, the developed image is transferred at transfer station D to a copy sheet. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detach the copy sheet from belt 10.

Following transfer, a conveyor 50 advances the copy sheet bearing the transferred image to fusing station E where a fuser assembly, indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the copy sheets. The duplex sheet is then fed through the same path as the simplex sheet to be advanced to finishing station F.

Copy sheets are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95 and rolls 72 move the sheet to transfer station station D.

After transfer station D, photoconductive belt 10 passes beneath corona generating device 94 which charges any residual toner particles remaining on belt 10 to the proper polarity. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

The various functions of machine 5 are regulated by a controller which preferably comprises one or more programmable microprocessors. The controller provides a comparison count of the copy sheets, the number of documents being recirculated, the number of copy sheets selected by the operator, time delays, jam corrections, etc. As will appear, programming and operating control over machine 5 is accomplished through a User Interface. Operating and control information, job programming instructions, etc. are stored in a suitable memory which includes both ROM and RAM memory types. Conventional sheet path sensors or switches may be utilized to keep track of the position of the documents and the copy sheets. In addition, the controller regulates the various positions of the gates depending upon the mode of operation selected.

Figure 2:
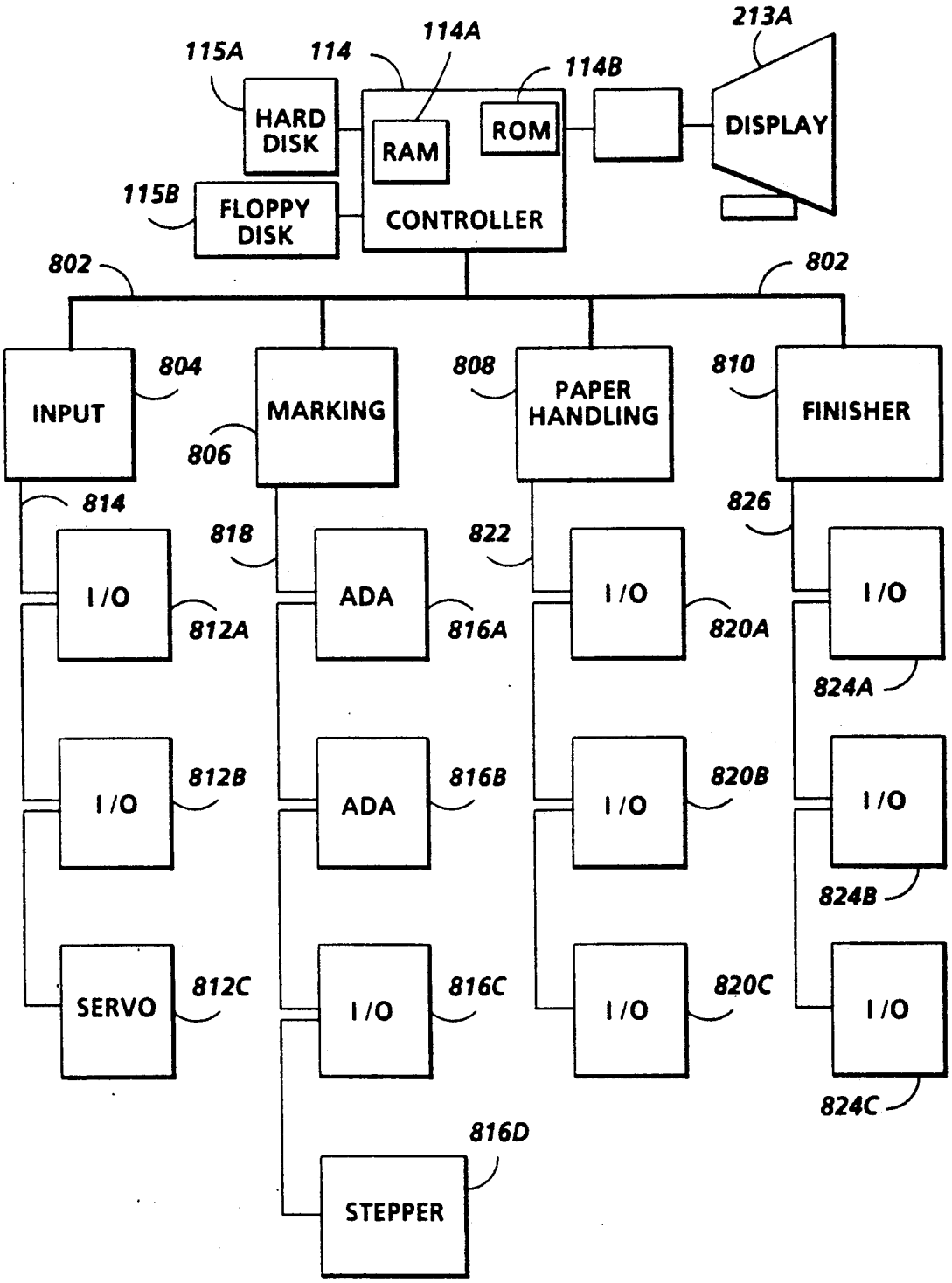
FIG. 2 is a block diagram of the operating control systems and memory for the machine shown in FIG. 1.

With reference to FIG. 2, the memory includes a hard or rigid disk drive 115A and a floppy disk drive 115B connected to Controller 114. In a preferred embodiment, the rigid disks are two platter, four head disks with a formatted storage capacity of approximately 20 megabytes. The floppy disks are 3.5 inch, dual sided micro disks with a formatted storage capacity of approximately 720 kilobytes. Preferably, all of the control code and screen display information for the machine is loaded from the rigid disk at machine power up. Changing the data that gets loaded into the machine for execution can be done by exchanging the rigid disk in the machine 5 for another rigid disk with a different version of data or by modifying the contents of the current rigid disk by transferring data from one or more floppy disks onto the rigid disk using the floppy disk drive built into the machine 5. Suitable display 213A of U.I. 213 is also connected to Controller 114 as well as a shared line system bus 302.

The shared line system bus 302 interconnects a plurality of core printed wiring boards including an input station board 304, a marking imaging board 306, a paper handling board 308, and a finisher/binder board 310. Each of the core printed wiring boards is connected to local input/output devices through a local bus. For example, the input station board 304 is connected to digital input/output boards 312A and 312B and servo board 312C via local bus 314. The marking imaging board 306 is connected to analog/digital/analog boards 316A, 316B, digital input/output board 316C, and stepper control board 316D through local bus 318. In a similar manner, the paper handling board 308 connects digital input/output boards 320A, B and C to local bus 322, and finisher/binder board 310 connects digital input/output boards 324A, B and C to local bus 326.

Figure 3:
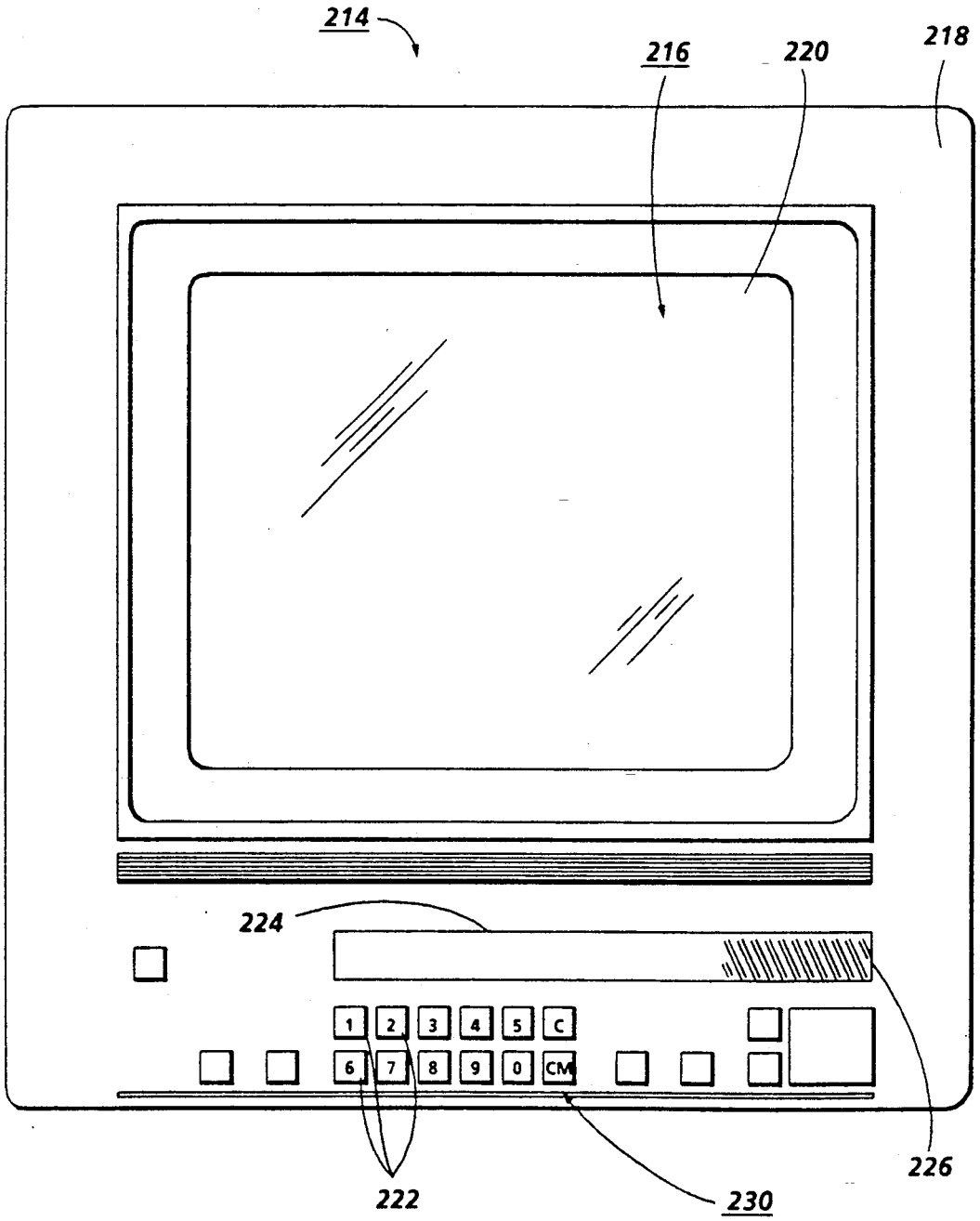
FIG. 3 is a front view of the User Interface color touch monitor for the machine of FIG. 1 showing the soft button display screen and hard button control panel.

Referring to FIG. 3, monitor 214 provides an operator user interface with hard and soft touch control buttons enabling communication between operator and machine 10. Monitor 214 comprises a suitable color cathode ray tube 216 of desired size and type having a peripheral framework forming a decorative bezel 218 thereabout. Bezel 218 frames a rectangular video display screen 220 on which soft touch buttons in the form of icons or pictograms and messages are displayed as will appear together with a series of hard control buttons 222 and 10 seven segment displays 224 therebelow. Displays 224 provide a display for copy "Quantity Selected", copy "Quantity Completed", and an area 226 for other information.

Hard control buttons 222 comprise "0-9" buttons providing a keypad 230 for programming copy quantity, code numbers, etc.; a clear button "C" to reset display 224; a "Start" button to initiate print; a clear memory button "CM" to reset all dialogue mode features to default and place a "1" in the least significant digit of display 224; an "Unload Stacker" button requesting transfer of the contents of stacker 128; a "Stop" button to initiate an orderly shutdown of machine 5; a "Binder Warm-up" button to initiate warm-up of binder 126; an "Interrupt" button to initiate a job interrupt; a "Proof" button to initiate making of a proof copy; an "End Job" button to end the current job; and an "i" button to initiate a request for information.

Figure 4:
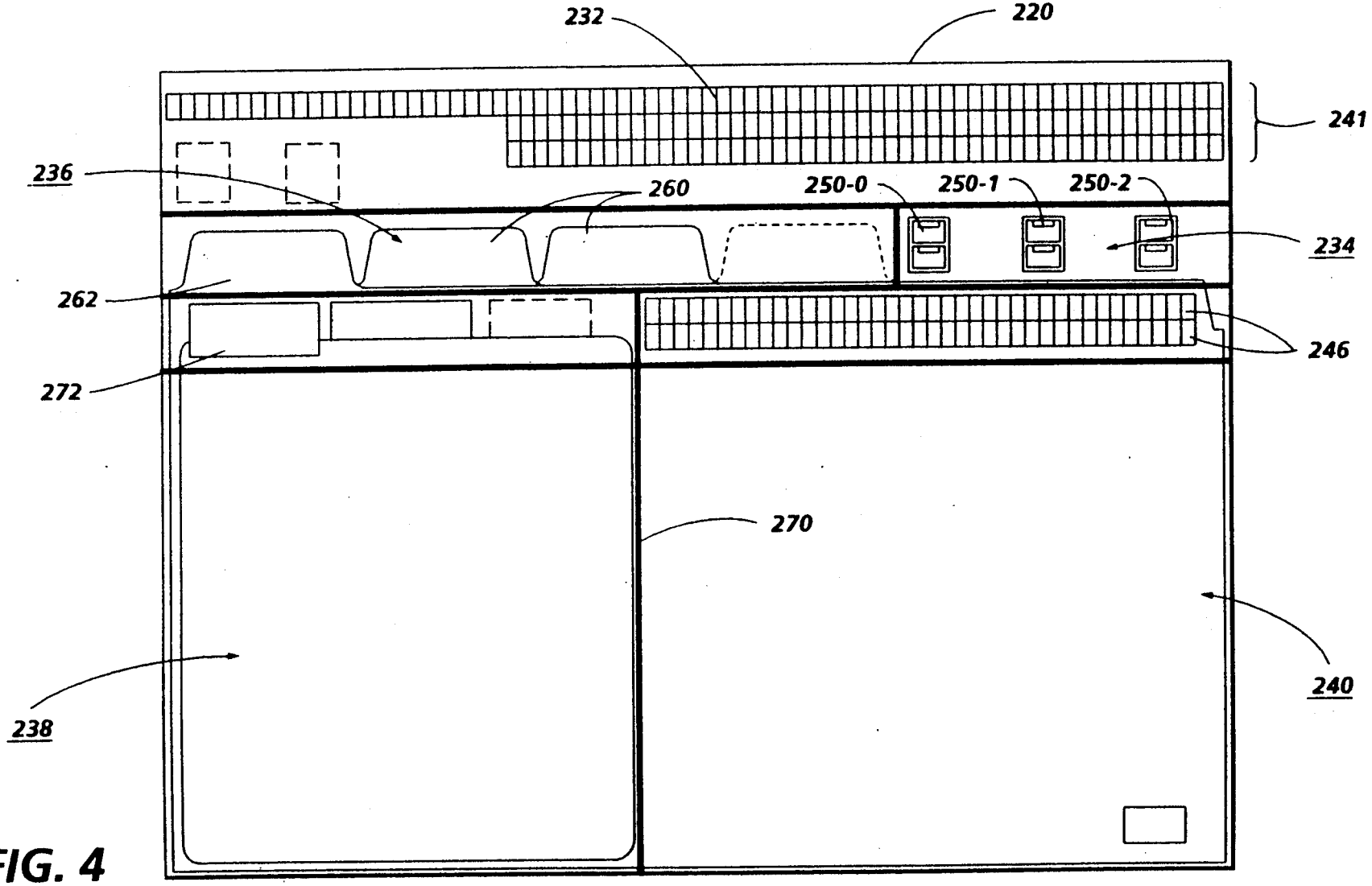
FIG. 4 is a front view of the touch monitor screen with the principal elements of the soft touch dialogue displayed.

Referring now to FIG. 4, for dialogue purposes, screen 220 of monitor 214 is separated into five basic display areas, identified as a message area 232, a dialogue mode selection area 234, a dialogue pathway selection area 236, a scorecard selection area 238, and a work selection area 240.

Message area 232 consists of 3 lines 241 located at the top of screen 220. In addition, two programming conflict message lines 246 are provided in work selection area 240. The dialogue mode selection area 234 comprises an active area containing certain top level dialogue mode controls available to the operator. The mode controls are soft touch buttons 250-0, 250-1, and 250-2 in the form of icons representing file cabinets located on the right side of the screen 220 directly below message area 232.

The dialogue pathway selection area 236 and the scorecard selection area 238 basically simulate a card within a card filing system with primary dialogue pathway file folders 260 and secondary file cards, the latter being referred to as scorecards 270. As will appear, scorecards 270 provide additional programming pathway options. File folders 260 and scorecards 270 are arranged in overlaying relation one in front of the other. The dialogue pathway file folders 260, which are located beneath message area 232 and which extend up into the dialogue mode area 234, each have an outwardly projecting touch tab 262 along the top edge identifying the dialogue pathway represented by the folder, as for example STANDARD, FANFOLD, OVERSIZED, etc.. To allow the file folders 260 to be distinguished from one another without the need to reshuffle the folders each time it is desired to display a folder hidden behind the folder currently displayed, each tab 262 is offset from the other so that tabs 262 are always visible whatever folder is displayed.

Figure 5:
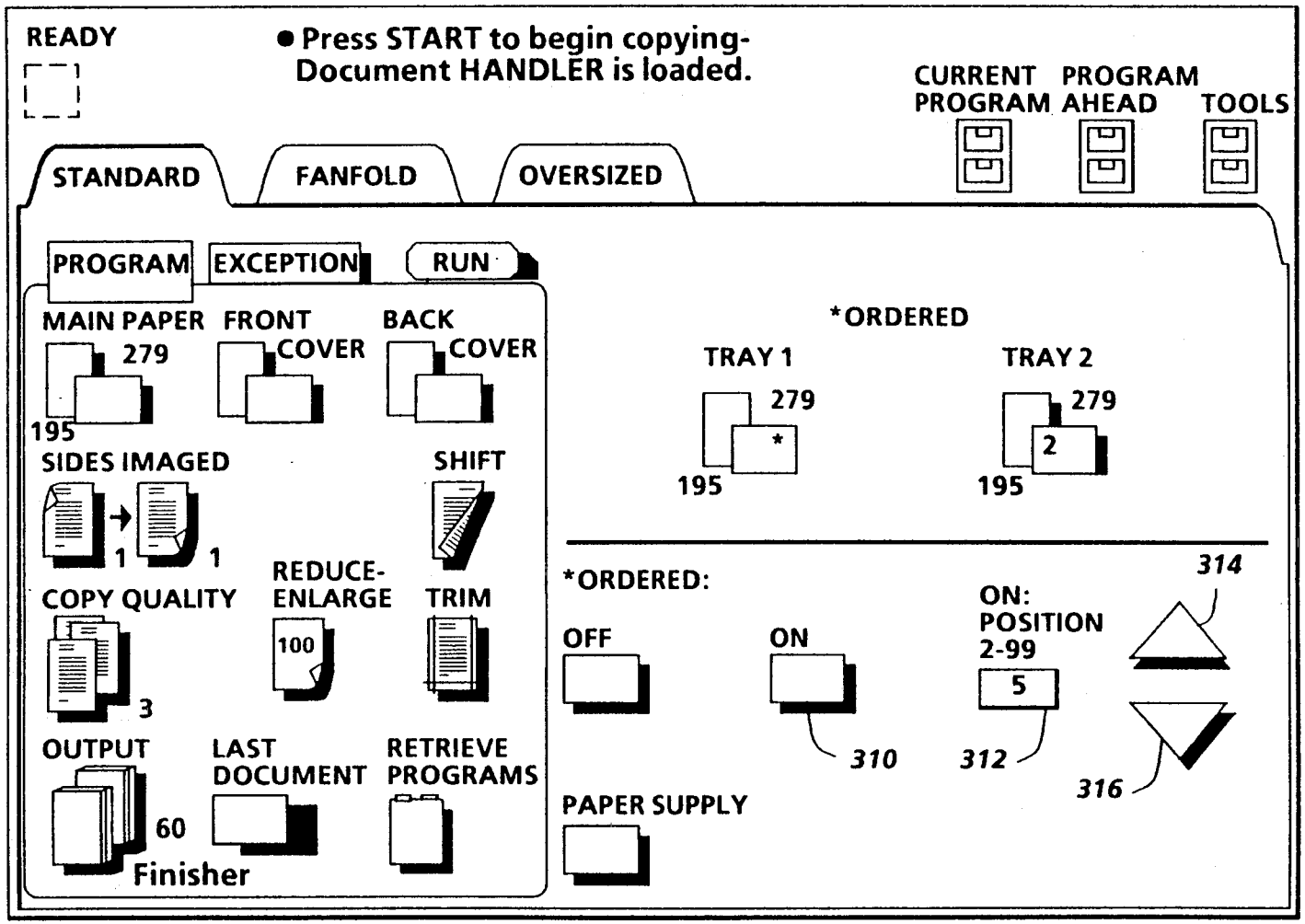
FIG. 5 is a front view of the touch monitor screen shown in FIG. 4 depicting the ordered stock feature of the present invention.

Scorecard selection area 238 appears in the lower left corner of screen 220 beneath dialogue selection area 234 and extends to the border of work selection area 240. Scorecard selection area 238 contains a file of scorecards 270 which present the features (first level program selections) available with each of the dialogue pathway file folders 260. As seen in FIG. 5 for example, area 238 displays the features (first level program selections) resident with the currently selected scorecard, such selections remaining at previously selected options until either timeout or the "CM" button (FIG. 4) is pressed. Two or three scorecards 270 are typically provided, depending on the dialogue pathway file folder 260 selected. Scorecards 270 each comprise a relatively small file card arranged in overlaying relation to one another so as to simulate a second but smaller card file. Each scorecard 270 has a touch tab 272 displaying the programming pathway options available with the scorecard, such as PROGRAM, EXCEPTION, or RUN. Scorecard tabs 272 are offset from one another to enable the identity of each scorecard to be determined whatever its position in the scorecard file. Additionally, scorecard tabs 272 are shaped different than the dialogue pathway file folder tabs 262 to prevent confusion.

Work selection area 240 appears in the lower right portion of screen 220, area 240 being beneath the dialogue pathway area 236 and extending from the edge of scorecard selection area 238 to the right side of screen 220. The top two lines 246 of the work selection area 240 are reserved for programming conflicts and prompts with the remaining area used for displaying the feature options (second level program selections) available with the first level program selection that is touched on the scorecard currently selected, an example of which is seen in FIG. 18. As will appear, the operator can scan and make a selection within the work area or pick another scorecard item.

In order for the soft touch buttons (i.e., icons) on screen 220 to provide information regarding both their current selection state and their current status, a display convention is provided that will allow the operator to quickly scan the display and determine current feature selections. Referring to Table 1, unselected features that are selectable are indicated by an outlined icon with a shadowed background while selected features that are selectable are indicated by a color-filled icon with a shadowed background. Unselected features that are not selectable are indicated by an outlined icon without a shadowed background while selected features that are not selectable are indicated by a color-filled icon without a shadowed background.

In cases where an unselected feature that is not selectable is touched, a message will be displayed in the programming conflict area 246 of screen 220. There are five operating states for U.I. 213 consisting of (1) CURRENT JOB, (2) PROGRAM AHEAD (3) TOOLS, (4) FAULTS, and (5) INFORMATION. The INFORMATION state is entered by means of a hard control button "i" on bezel 218 while the FAULTS state is in the form of a file card that overlays the file cards currently displayed in the event of a fault. The CURRENT JOB, PROGRAM AHEAD, and TOOLS states are entered by pressing the soft touch buttons 250-0, 250-1 and 250-2 respectively displayed on screen 220 in the Dialogue Mode Selection area 234.

For purposes of discussing the present invention, U.I. 213 is presumed to be in the CURRENT JOB state as a result of the actuation of soft touch button 250-0. When entered in the CURRENT JOB state, the dialogue pathway file folders 260 tabbed STANDARD, OVERSIZED, and FANFOLD are displayed providing various dialogue pathway selections in the form of scorecards 270. The function and the behavior of these tabbed file folders within the dialogue pathway selection area 236 for the "Job Complete", "Job Incomplete", and "Print" cases as well as further details of the above described system are further described in D/87184, application Ser. No. 07/164,365 filed Mar. 3, 1988 and incorporated herein.

The ordered stock feature can be used in a variety of situations. For example, the operator has five position tab stock and will use all five positions in each set produced. In order for the machine to adjust the tray containing the tabs to the correct sheet in the event of a shutdown in which some tabs were lost in the paper path, the machine must know that ordered stock is loaded in the tray and how many unique positions there are. The operator makes a selection on the User Interface indication that ordered stock is loaded in the tray. The operator then programs the five tabs as inserts or special paper through the Exception Programming dialogue. When the machine is started the software determines that five uses are programmed for the tray and uses this as the unique number of sheets in the tray. As the job progresses the software is monitoring feeds from the tray to guarantee that each set comes out the same.

In another example, pre-ordered tabs usually are produced in an established number of positions, typically three or five. If an operator has only five position tab stock available and wants to use four of those positions in each set, then in the past the operator would have to manually remove the fifth position from each set of tabs in his stock prior to running the job. In accordance with the present invention, that need is eliminated because the dialogue allows the user to program the four uses of the tabs and then to also enter on the User Interface the unique number tab positions loaded in the tray: in this case, five. The software tracks each feed from the tray and, between each set produced, discards the fifth position tab by purging it to the top output tray.

In another example, tray 3 supplies the main stock for the job. A front cover is desired of a particular color, a back cover is desired of a different color, and several inserts are desired of yet a different color. Four different stocks are in use and yet the machine only provides three source trays. The operator can load the pre-ordered insert stock in one of the remaining trays, and can order the two cover stocks by alternating a front cover sheet and then a back cover sheet continuously and then load this into the remaining tray. If the operator indicates that this tray contains ordered stock then the machine will guarantee that the front and back covers in each set will always be of the correct respective colors. In this way, the ordered stock feature in one respect can be thought of as providing pseudo-trays.

The ordered stock feature is initiated by a (not shown) ordered stock button on screen 220. Activation of this button results in a screen display as illustrated in FIG. 5 in accordance with the present invention. The display includes icons representing Tray 1 and Tray 2. It should be noted that any number of trays are contemplated within the scope of the invention.

The ordered stock feature is initiated by either activating the "on" button 310 shown on the screen or scrolling a specific modulus number, for example 5, as shown in the modulus window 312 by use of scrolling buttons 314 and 316. If the on button is activated, the modulus number (number of ordered stock sheets in a set) is assumed to equal the tray usage programmed number as will be further explained with reference to FIGS. 6A, 6B, and 6C. Alternatively, the operator can designate a specific modulus number by use of buttons 314 and 316 as will also be further explained with reference to FIGS. 6A, 6B, and 6C.

Figure 6A:
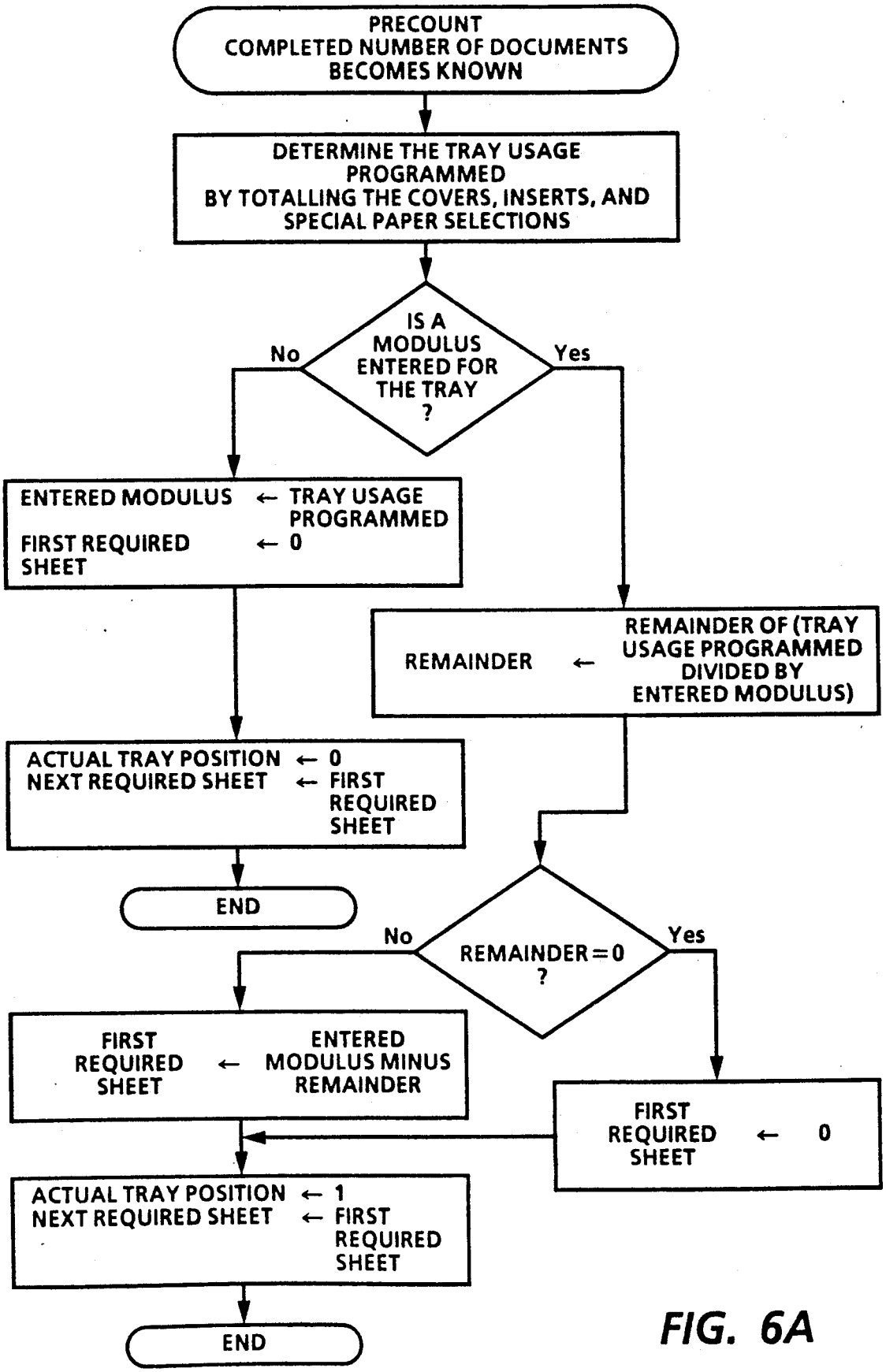
FIGS. 6A, 6B and 6C are flow charts depicting the ordered stock method in accordance with the present invention.

With reference to FIG. 6A, The ordered stock feature is initiated by a (not shown) Ordered Stock button on screen 220. Activation of this button results in a screen display as illustrated in FIG. 5 in accordance with the present invention. The display includes icons representing Tray 1 and Tray 2. It should be noted that any number of trays are contemplated within the scope of the invention.

The ordered stock feature is initiated by either activating the "on" button 310 shown on the screen or scrolling a specific modulus number, for example 5, initial processing and set up conditions are performed at the beginning of a job. After a precount of the number of documents in a set to be copied has been completed, a determination is made of the tray usage programmed by totaling the number of covers, inserts and or special paper selections required for 1 set. A special paper selection could be an insert that also requires imaging. The first decision is whether or not a modulus has been entered for the tray containing the covers inserts or special paper selections. The entered modulus is the number entered by the operator on the user interface and it represents the total number of ordered stock sheets in a set. For example, if tabs or dividers come in sets of 5, and the tray is loaded with sets of 5, the modulus would be the number 5.

The tray usage programmed, as stated, is the number of uses from a tray that is programmed per set. That is, it is the total number of covers, inserts or special paper selections that will be needed from a tray for each complete set of documents reproduced. If three dividers or inserts are needed per set, then the number 3 is the tray usage that is programmed into the machine. As will become apparent, the essence of the invention is to be able to program a job for a given number of inserts or dividers per each document set for example 3 even though the dividers or inserts have been loaded into a special tray in different groups, for example, in groups of five.

If no modulus has been entered, that is, a reference number for the frequency or repetition of the ordered stock loaded into the order stock tray, the machine assumes that the modulus number is the same as a tray usage programmed number. Though the discussion for simplicity reasons refers to only one tray holding ordered stock, it is within the scope of the present invention to have several trays with different types of ordered stock. Also, if no modulus has been entered, the number 0 is automatically entered in a location to indicate 0 as the number of sheets to purge as a result of an ordered stock discrepancy or jam. The actual tray position is also set to 0 as well as the next required sheet.

If a modulus has been entered, the control will then set up a ratio of the tray usage programmed over the entered modulus and use the remainder from this ratio to make a purge decision. In other words, as represented by the remainder equal 0 in the decision block, if the remainder equals 0, indicating the tray usage programmed to entered modulus ratio is an integer number, the system will recognize a complete cycle or document set having been completed and the necessity to purge a given number of dividers or inserts that may be in a set, exceeding the tray usage programmed number. It should also be noted that the example is being described with reference to inserts or dividers, but that cover sheets and other types of special stock selections such as inserts or dividers with imaging could be used as well. If the remainder is not 0, then the first required sheet is the difference of the entered modulus less the remainder.

The first required sheet is a value that is required when a new copy set is started. It is the number used in determining how many sheets to purge from the tray when the tray usage programmed number is not an even multiple of the entered modulus. It should also be noted that the next required sheet is the value that indicates the next sheet needed in terms of the tray usage programmed. If the machine stops or is jammed, this value is updated by the control so that it represents the next sheet required when the machine resumes operation again. In this manner the machine can adjust for any sheets lost in the paper path. Also, the actual tray position is the number that tracks the feeds in a tray and is set back to 0 when the number exceeds the entered modulus. As illustrated in FIG. 6A, in either option having the first required sheet set to 0 or the first required sheet set to the modulus number less the remainder, the next step is to set the actual tray position to 1 and the next required sheet to the first required sheet.

Figure 6B:
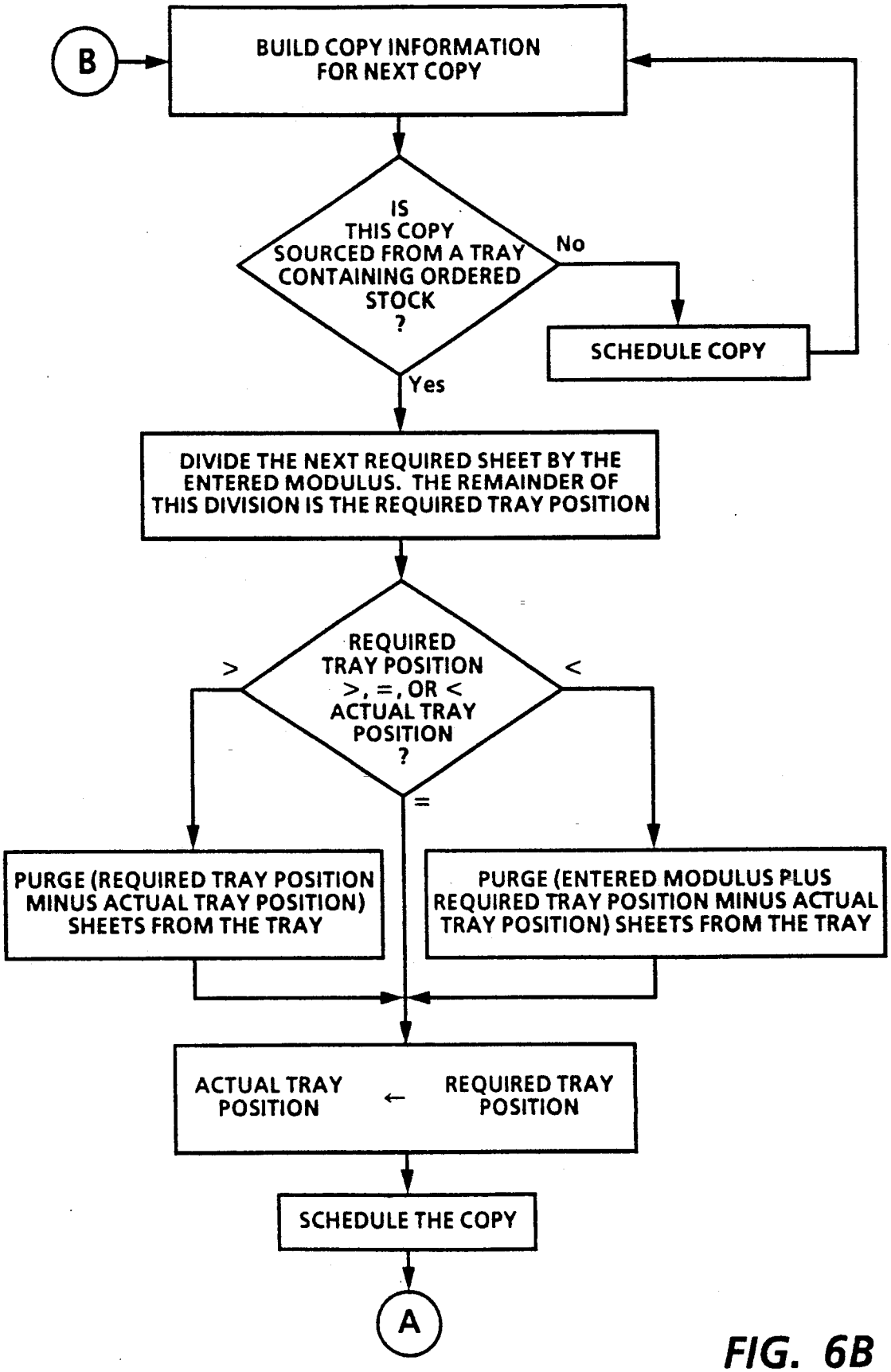
Figure 6C:
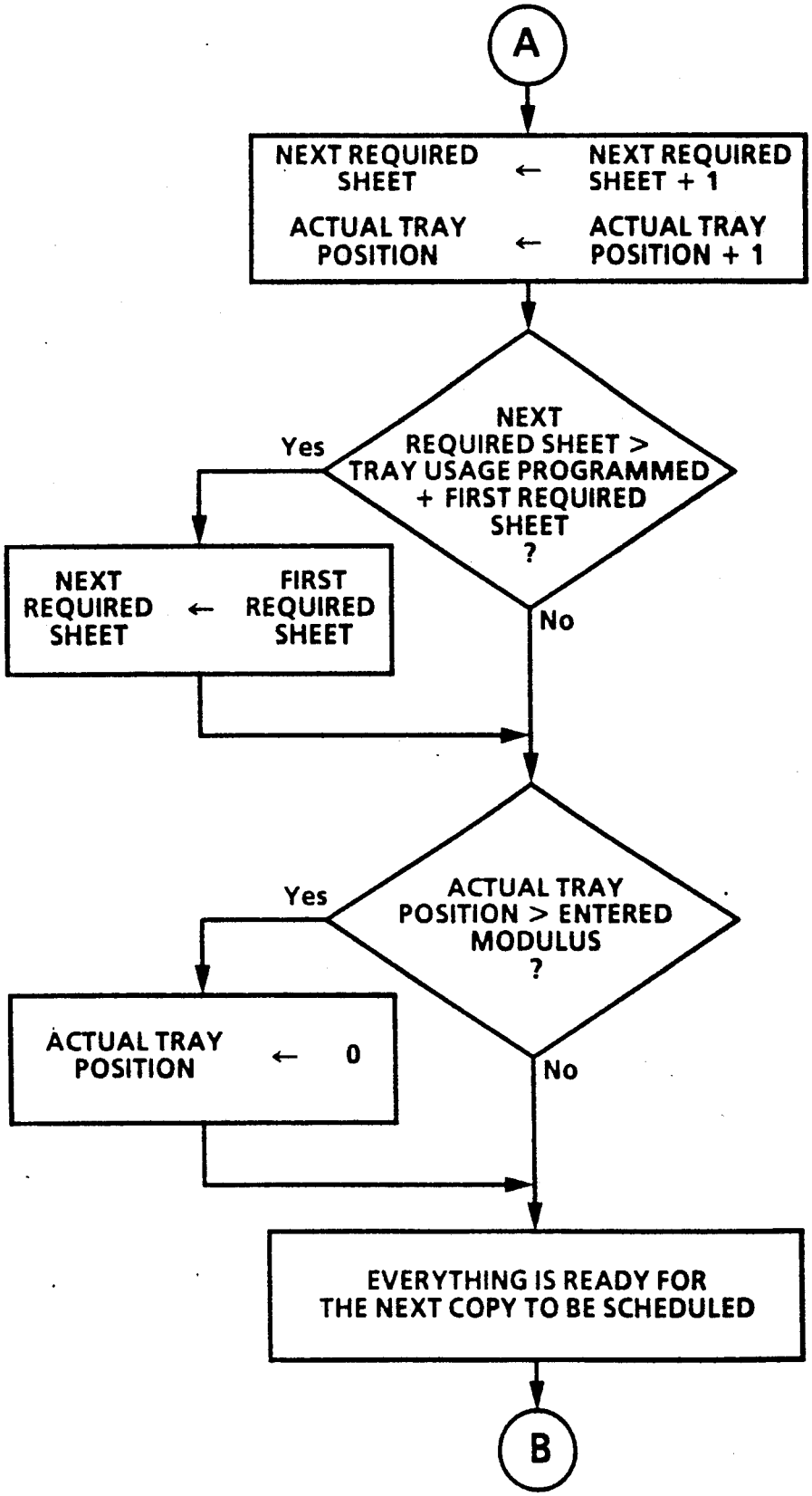

FIG. 6B and 6C illustrate the processing performed each time a copy is scheduled in the control. That is, this is the procedure for suitably purging the ordered stock during the operation of the machine to complete a reproduction run. The build copy information for next copy block simply is the routine scheduling that is done for each copy. The first decision is whether or not the copy is sourced from a tray containing ordered stock. If not, the routine scheduling for the next copy is performed. If the copy is to be sourced from a tray containing ordered stock, the next step is to divide the next required sheet by the entered modulus. The result or remainder of this division is the required tray position.

A comparison is then made between the required tray position and the actual tray position. If the required tray position is less the actual tray position, there will be a purge. The purge of the sheets from the tray will be those sheets corresponding to the entered modulus plus the required tray position less the actual tray position. The next step is to set the actual tray position to the required tray position. If the required tray position is greater than the actual tray position, there will be a purge of sheets from the tray based upon the required tray position minus the actual tray position. The next step is to set the actual tray position to the required tray position. If the required tray position is equal to the actual tray position, the actual tray position is set to the required tray position and the next copy is scheduled.

As illustrated in FIG. 6C, the next step is simply to increment the next required sheet in the actual tray position. The next decision is whether or not the next required sheet is greater than the tray usage programmed plus the first required sheet. If the next required sheet is not greater than the tray usage programmed plus the first required sheet, then a decision whether or not the actual tray position is greater than the entered modulus is made. If not, the next copy is scheduled.

However, if the next required sheet is greater than the tray usage programmed plus the first required sheet, then the next required sheet is incremented, and if the actual tray position is greater than the entered modulus, then the actual tray position is set to 0 and the system is reset for the next set of documents to be copied and a required number of ordered stock sheets in the order sets are purged to repeat the next cycle.

While the invention has been described with reference to the structure disclosed, it is not confined to the details set forth, but is intended to cover such modifications or changes as may come within the scope of the following claims.

We claim:

1. In a printing system having a machine with a plurality of operating components, a control with operator interface, the control cooperating with the operating components to produce images on copy sheets, an output station for receiving sets of said copy sheets, and a source of insert sheets having a predetermined repetitive frequency, the insert sheets being provided at given locations within the sets of the copy sheets, the method of automatically ordering the insertion of the inserts within said sets comprising the steps of:

selecting an automatic insert ordering option at the operator interface, programming the required order of the inserts in a set of copy sheets received at the output station, determining the repetitive frequency of the insert sheets, and automatically selectively performing one of inserting and discarding insert sheets in order to provide sets of copy sheets with uniform inserts upon determining that the required number of inserts is more or less than said repetitive frequency.

2. In a printing system having a machine with a plurality of operating components, a control with operator interface, the control cooperating with the operating components to produce images on copy sheets, an output station for receiving sets of said copy sheets, and a source of insert sheets having a predetermined repetitive frequency, the insert sheets being provided at given locations within the sets of the copy sheets, the method of recovering from a machine jam comprising the steps of:

purging the machine of unusable copy sheets or inserts in process, determining the repetitive frequency of the insert sheets, automatically reordering the insert sheets in order to provide sets of copy sheets with uniform inserts, and continuing operation to provide uniform completed sets of copy sheets and inserts.

3. A method of automatically placing ordered paper stock from sets of paper stock into finished copy sets in a reproduction job run and automatically recovering from a machine paper jam in which the copy sheets or paper stock in process has become misoriented comprising the steps of selecting an automatic paper stock ordering option at the operator interface, programming the required order of the paper stock in a finished set of reproduced documents, determining the repetitive frequency of the insert sheets, automatically selectively performing one of inserting and discarding insert sheets in order to provide sets of copy sheets with uniformly placed paper stock, and automatically recovering after an operator jam clearance by selectively purging paper stock to maintain the continuity of the ordered paper stock in the completed copy sets.

4. A method of automatically placing ordered paper stock from sets of paper stock having a predetermined number per set into finished copy sets in a reproduction job run comprising the steps of selecting an automatic paper stock ordering option at the operator interface, programming the required order of the paper stock in a finished set of reproduced documents, determining the predetermined number per set of the ordered paper stock, and automatically selectively performing one of inserting and discarding insert sheets in order to provide sets of copy sheets with uniformly placed paper stock.

5. A method of automatically recovering from a machine paper jam in which paper stock in process has become mis-oriented comprising the steps of selecting an automatic paper stock ordering option at an operator interface, programming the required order of the paper stock in a finished set of reproduced documents, determining the repetitive frequency of the paper stock, and automatically recovering after an operator jam clearance by selectively purging paper stock to maintain the continuity of the ordered paper stock in the completed copy sets.

* * * * *